US005687708A

United States Patent [19]

Farnsworth et al.

[11] Patent Number: 5,687,708

[45] Date of Patent: Nov. 18, 1997

[54] GAS-FIRED BATCH BOOSTER WATER HEATER APPARATUS

[75] Inventors: Craig Farnsworth, Chagrin Falls; Michael Aronov, Beachwood; Gary Liljenberg, Brooklyn; John Schmidt, Brunswick, all of Ohio; Buddy J. Austin, Portland, Tenn.

[73] Assignee: Gas Research Institute, Chicago, Ill.

[21] Appl. No.: 550,445

[22] Filed: Oct. 30, 1995

[51] Int. Cl.[6] ..... F24H 1/22

[52] U.S. Cl. ..... 126/362; 126/350 R; 126/351

[58] Field of Search ..... 126/350 R, 351, 126/350 D, 362, 350 C

[56] References Cited

U.S. PATENT DOCUMENTS 2,852,018 9/1958 Williams ..... 126/362

2,948,277 8/1960 Dennis ..... 126/362

3,575,157 4/1971 Whittel, Jr. ..... 126/362

5,201,807 4/1993 Liljenberg et al. ..... 122/18

*Primary Examiner*—Carl D. Price

*Attorney, Agent, or Firm*—Dick and Harris

[57] ABSTRACT

A gas-fired batch booster water heater for supplying sanitizing water to a dish washing machine comprises a chamber member, a water inlet tube, a gas-fired burner, a water outlet tube, a valve member, and a member for circulating water through the chamber member. The chamber member has a first opening operably attached to the water inlet tube and a second opening operably attached to the water outlet tube. The chamber member comprises an integrated heat exchanger and water tank. The gas-fired burner heats the water in the chamber member as it is circulated. The gas-fired batch booster water heater may further include a temperature sensor associated with the water inlet tube for controlling activation of the member for circulating water through the chamber member.

5 Claims, 2 Drawing Sheets

GAS-FIRED BATCH BOOSTER WATER HEATER APPARATUS

BACKGROUND OF THE INVENTION

1. Field of the Invention

The present invention is directed to water heaters, and more specifically, to a batch booster water heater apparatus for supplying sanitizing water to a dish washing machine.

2. Background Art

Generally, commercial dish washing machines operate with water heated to temperatures in the range of 110° F. to 160° F. Water of this temperature is generally provided to the dish washing machine by a primary water heater or by a recycle of the final sanitizing rinse from the previous cycle. Each dish washing machine cycle terminates with a final rinse, also referred to as the sanitizing rinse.

The sanitizing rinse water temperature is usually in the range of 180° F. to 195° F. A rinse at such an elevated water temperature raises the temperature of the dishes and other wares within the machine to in excess of 160° F. This is the minimum temperature necessary to effectively sanitize dishes and other wares within the machine. An elevated water temperature additionally serves to facilitate air drying of the dishes and other wares.

Water is supplied to the final rinse at a flow rate of approximately eight to nine gallons per minute. A typical dish washing machine requires between one and two gallons of sanitizing water. Accordingly, the water will be supplied for approximately seven to ten seconds.

The water which enters the dish washing machine at the sanitizing temperature is generally supplied by a booster water heater—a unit separate from the dish washing machine. Such booster heaters draw from the general cycle dish washing machine water supply having a temperature of 110° F. to 160° F., then heat this water to between 180° F. and 190° F. by first running the water through a heat exchanger and then storing the heated water in a water tank until needed. Inasmuch as these heaters continuously heat water to the sanitizing temperature, and inasmuch as such water is not supplied continuously to the dish washing machine (but in batches), the excess water must be stored in a storage tank. When required by the dish washing machine, the water that has been heated to the sanitizing temperature and, in turn, stored, is supplied to the dish washing machine, thereby completing the final rinse. Accordingly, these types of booster heaters constantly heat and maintain the water at the sanitizing temperature.

The heaters that are capable of continuous water flow for the sanitizing rinse cycle typically suffer from dimensional problems. These booster heaters, in part due to the often large storage tank for storing the continuously heated water, are hard to place in a commercial setting. Even when the height and the depth can be controlled, the width of these is often quite large, thus occupying a significant under-counter top area. Space in a commercial kitchen, having a complement of burners, ovens, broilers, washing sinks, refrigeration and chiller apparatus, is of a great premium. Accordingly, the size of the unit is of utmost importance.

For commercial applications, the maximum dimensions of the booster water heater are restricted. Generally, the height of the unit should be no greater than thirty inches. Inasmuch as the height of a typical counter top is thirty-six inches, the unit may be installed six inches off of the ground, thus facilitating cleaning in and around the unit. Additionally, the depth of the unit should be no greater than the width of most counter tops, such as to be capable of mounting flush with the front edge of the counter top. Lastly, the unit should also be designed to occupy minimum width allowing for the placement of other devices.

Moreover, these types of heaters have many components for storing water. Not only do these "extra" components increase the cost of the unit, but they also contribute to a greater chance of failure, such as leaks. Additionally, these units are not generally very efficient, inasmuch as unused water must be maintained within the storage tank where, without adequate insulation, the temperature of the stored water will drop quickly.

While booster water heaters that continuously heat water have been around for many years, most of these booster water heaters are powered by electric heating elements. Applicant is aware of Liljenberg, U.S. Pat. No. 5,201,807, which discloses a gas-fired booster water heater that provides a continuous flow of water at the sanitizing temperature. Applicant is unaware of any gas-fired batch booster water heater which integrates the heat exchanger and the storage tank, such as is done by the present invention.

SUMMARY OF THE INVENTION

The present invention is concerned with providing a gas-fired batch booster water heater apparatus for supplying sanitizing water to a dish washing machine. The apparatus is capable of providing water at the sanitizing temperature in batches—as needed by the dish washing machine—while minimizing the components and minimizing the overall dimensions of the apparatus.

The gas-fired batch booster water heater apparatus, comprises a chamber member, a water inlet tube, a gas-fired burner, a water outlet tube, a valve member, and means for circulating water. The chamber member comprises an integrated water tank and heat exchanger, and includes a first opening and a second opening.

In a preferred embodiment of the invention, the chamber member includes twelve water tubes, each having a first end and a second end. A top header is integrally associated with the first end of the water tubes and a bottom header is integrally associated with the second end of the water tubes. Accordingly, the top and bottom headers connect the twelve water tubes, thereby allowing water to circulate through these tubes continuously—creating an extended flow pattern.

The water inlet tube is operably attached to one of the first or second openings. The water inlet tube allows a predetermined quantity of water into the chamber member. A gas-fired burner, positioned proximate the chamber member, heats the predetermined quantity of water within the chamber to the sanitizing temperature.

The water outlet tube is operably attached to the other of the first or second opening which is not attached to the water inlet tube. The water outlet tube allows for the release and, in turn, flow of the predetermined quantity of water which has been heated to the sanitizing temperature, from the chamber. The valve member is operably associated with the outlet tube and precludes the flow of water from the chamber member through the water outlet tube into the dish washing machine until such time as it is needed for the final rinse.

The means for circulating the predetermined quantity of water within the integrated storage tank and heat exchanger maintains the motion of the water at a certain velocity within the chamber to insure the uniform heating of water. The circulating means may comprise a pump with adequate power to force the water at a calculated, predetermined circulation flow rate.

In one preferred embodiment, the invention further comprises means for sensing the flow of water through the water inlet tube and means for controlling the valve member from a normally open position to a closed position. The valve control means is operably associated with the flow sensing means. Further, the valve control means includes means for manipulating the valve member upon detection by the flow sensing means of the flow of water from the inlet tube, a predetermined period of time after sensing of the flow of water. Accordingly, upon the detection of flow of unheated water into the water inlet tube by the sensing means, the sensing means will alert the valve control means to move to the closed position, after a predetermined time period—thus allowing the unheated water to enter and replace the exiting water which has been already heated to the sanitizing temperature. The sensing means may comprise a thermal sensor capable of sensing a change in water temperature.

In this preferred embodiment, the chamber member may comprise a heat exchanger and a separate water storage tank. With the separate storage tank, the chamber member may retain a greater quantity of water that is heated to the sanitizing temperature. Thus, it may be used in conjunction with larger capacity dish washing machines. Nevertheless, this embodiment still manipulates the valve on the water outlet tube with a thermal sensing device associated with the water inlet tube.

DETAILED DESCRIPTION OF THE DRAWINGS

Figure 1:
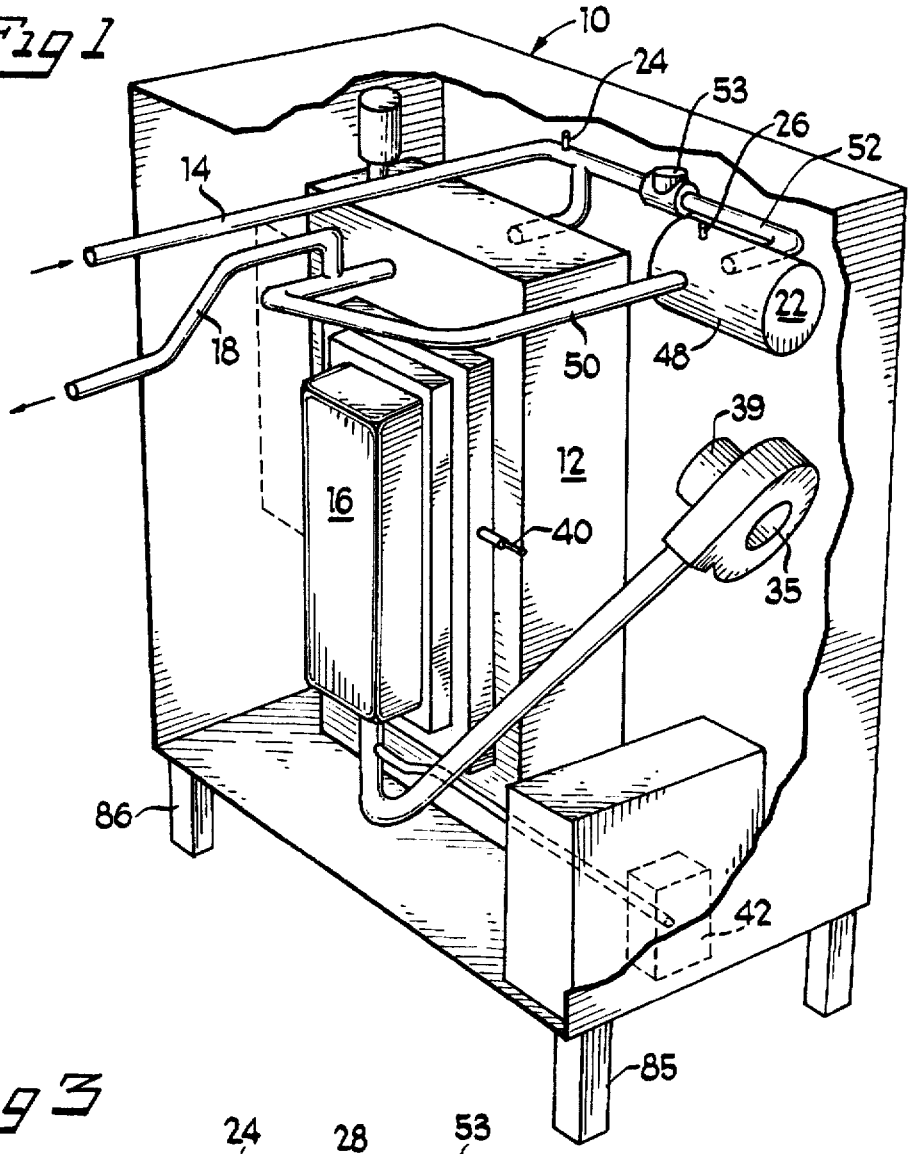
FIG. 1 of the drawings is a perspective view of the gas-fired batch boost water heater.

While this invention is susceptible of embodiment in many different forms, there is shown in the drawings and will herein be described in detail, one specific embodiment with the understanding that the present disclosure can be considered as an exemplification of the invention and is not intended to limit the invention to the embodiment illustrated.

Figure 3:
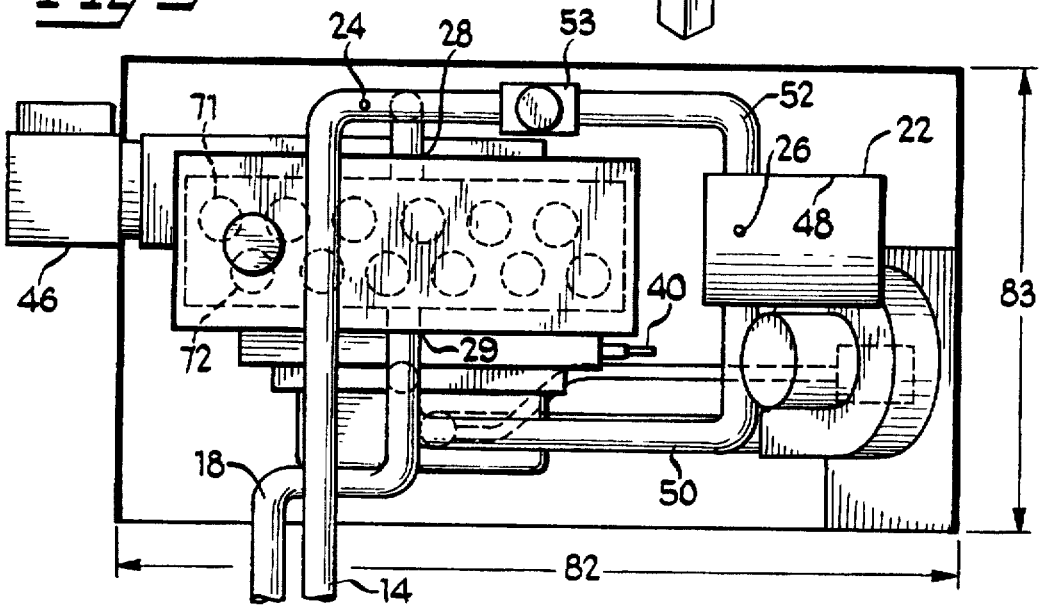
FIG. 3 of the drawings is a cross-sectional view of the gas-fired batch boost water heater taken along lines 2—2 of FIG. 2.
Figure 2:
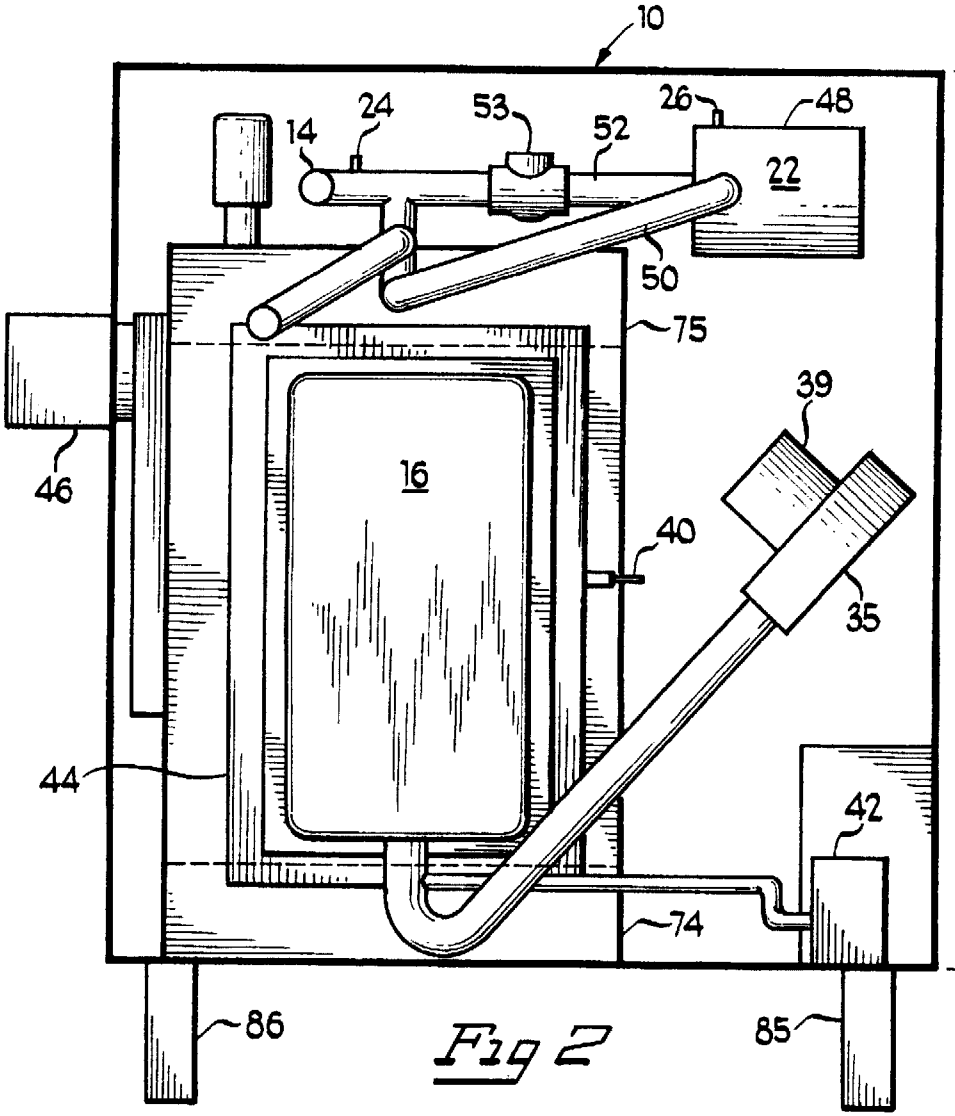
FIG. 2 of the drawings is a front view of the gas-fired batch boost water heater with the housing removed.

Gas-fired batch booster water heater apparatus 10 is shown in FIG. 1 and FIG. 2 as comprising chamber member 12, water inlet tube 14, gas-fired burner 16, water outlet tube 18, and means 22 for circulating the water ("water circulating means") within the chamber member. Gas-fired batch booster water heater apparatus 10 supplies sanitizing water to dish washing machine (not shown). Chamber member 12 includes a first opening 28 and a second opening 29 (FIG. 3). Chamber member 12 comprises an integrated heat exchanger and water tank. Indeed, the integration of a heat exchanger and a water tank greatly simplifies the apparatus and decreases the overall dimensions of the gas-fired batch boost water heater apparatus.

Figure 4:
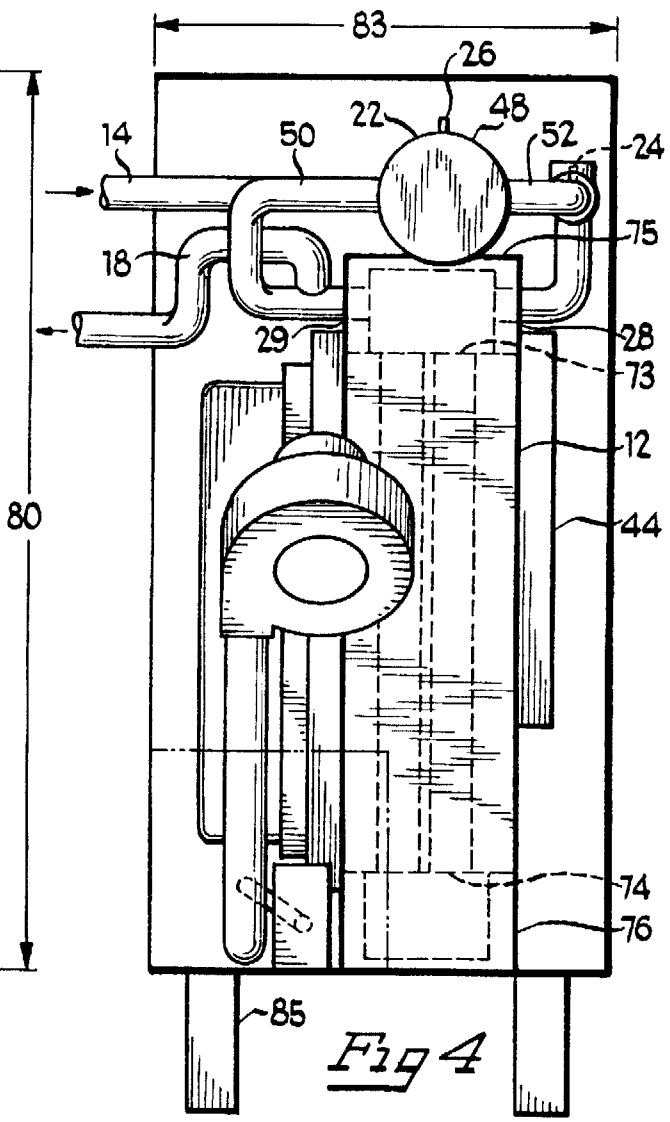
FIG. 4 of the drawings is a side view of the gas-fired batch boost water heater with the housing removed.

As seen in FIG. 3 and FIG. 4, chamber member 12 comprises tubes, such as tubes 71, 72. Each water tube has first end 73 operably associated with top header 75. Similarly, each water tube has second end 74 operably associated with bottom header 76. While other configurations are contemplated, in a preferred embodiment, chamber member 12 includes a total of twelve water tubes. The tubes are arranged in a manner to allow the water to circulate through an extended path of comprising multiple tubes.

Water inlet tube 14 is operably attached to first opening 28. The water inlet tube allows inlet of a predetermined quantity of water into the chamber member. The incoming water is generally water which has been heated to a temperature of 140° F. prior to entering through water inlet tube 14. Thus, water inlet tube 14 is generally attached to the hot water supply line from a conventional hot water heater. Of course, it is also contemplated that water inlet tube 14 may be attached to an unheated "cold" water line—thus requiring greater heating.

Similarly, water outlet tube 18 is operably attached to second opening 29 of chamber member 12. Water outlet tube 18 allows for the release and, in turn, flow of the heated predetermined quantity of the water from the chamber member 12.

Gas-fired burner 16, as shown in FIG. 2, comprises air source 35, blower 39, igniter 40, gas valve 42, flue collector 44 and flue outlet 46. While other gas sources are contemplated, the gas-fired burner may be a typical infrared burner apparatus. Air source 35 is supplied by blower 39 and provides air into the combustion chamber. Similarly, gas valve 42 controls the flow of the gas. The burned exhaust fumes exit flue outlet 46, Which may be configured to be vent free, directing exhaust fumes into the atmosphere or configured with a vent collar adapter to permit connection to other units which treat and/or handle exhaust fumes.

As shown in FIG. 2 and FIG. 4, water circulating means 22 comprises circulation pump 48, pump supply line 50, pump exhaust line 52, and check valve 53. Circulation pump 48 draws water through pump supply line 50 which is attached to water outlet tube 18 and into pump 48. The water exits out through pump exhaust line 52, which is attached to water inlet tube 14. The circulation pump precludes the stagnation of water within chamber member 12 to, in turn, aid in the even heating of the water. Further, circulation pump 48 prevents damage to chamber member 12 which could otherwise occur if the water was allowed to stagnate or remain motionless within chamber member 12. Check valve 53 remains in the closed position when water is introduced into water inlet tube 14 thereby appropriately directing such water to chamber member 12.

Gas-fired batch booster water heater 10 may further include means 24 for sensing the flow of water through inlet tube 14 and circulation control means 26. While sensor means 24 may comprise a thermal sensor capable of sensing a change in water temperature, other conventional sensing devices are also contemplated for use. Circulation control means 26 is operably associated with the flow sensing means and circulation pump 48. Circulation control means 26 is capable of energizing and de-energizing circulation pump 48. Accordingly, circulation pump 48 remains de-energized long enough to permit unheated water to enter chamber member 12 and to permit heated water to exit the chamber member without mixing.

As shown in FIG. 2, FIG. 3 and FIG. 4, due to this compact component minimizing design, the gas-fired batch boost water heater maintains minimal dimensions. Height 80 of the gas-fired batch boost water heater may be twenty-seven inches. Thus, legs greater than six inches, such as legs 85, 86, may be used as a stand. These legs are high enough to easily facilitate cleaning around the apparatus. Even with legs that are greater than six inches, the apparatus easily fits below a counter top. Further, depth 82 of the apparatus may be only twenty-five inches, which is significantly less than the depth of a conventional counter top. By minimizing the number of components, width 83 can be less than fourteen inches. Accordingly, the apparatus may be easily accommodated even in a crowded commercial kitchen setting. Even with such compact dimensions, gas-fired batch boost water heater apparatus 10 is capable of supplying bursts of up to 1.6 gallons of water in greater than one minute intervals. This supply is satisfactory for most batch-type dish washing machines conventionally used in a commercial setting.

In operation, gas-fired batch booster water heater 10 accepts unheated water through water inlet tube 14, into chamber member 12. The water continues to enter through the water inlet tube until a predetermined amount of water is in chamber member 12. Check valve 53 then changes position such that water may be drawn through circulation means 22. At such time, pump 48 begins to circulate the water within the chamber member.

While the water is circulated, gas-fired burner 16 heats the water inside of chamber member 12 until the water reaches the sanitizing temperature. When the dish washing machine requires water, the water that is used in the sanitizing rinse exits through water outlet tube 18. At the same time, fresh unheated water enters through water inlet tube 14 to replace the sanitizing water exiting through water outlet tube 18.

The entry of the fresh water through the water inlet tube triggers sensor means 24. At such time, circulation pump 48 is de-energized, allowing water that has been heated to the sanitizing temperature to exit through water outlet tube 18 without mixing with inlet water. A predetermined amount of time after the sensor means has sensed the flow of water through inlet tube 14, circulation pump 48 is re-energized. The cycle is then repeated until such time that the dish washing machine no longer requires water at the sanitizing temperature.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A gas-fired batch booster water heater apparatus for supplying sanitizing water to a dish washing machine, the gas-fired batch booster water heater comprising:

a chamber member capable of holding water having an inlet, an outlet, an inner heat radiating surface and an outer heat receiving surface;

a gas fired burner positioned in close proximity to the chamber member, the gas fired burner capable of supplying heating the heat receiving surface of the chamber and, in turn, the water;

a first circuit associated with the inlet and the outlet, the first circuit including means for circulating the water within the chamber member;

a second circuit associated with the first circuit, the second circuit being capable of introducing water into the chamber member for heating and removing water from the chamber member to a dish washing machine upon heating of the water;

a check valve associated with the first circuit and the second circuit;

means for sensing the flow of water through the second circuit; and means associated with the sensing means for controlling the check valve, to, in turn, control the flow of water through either of the first and the second circuits.

2. The invention according to claim 1 wherein the control means includes means for directing the circulating means to circulate the water or to preclude circulation of water.

3. The invention according to claim 1 wherein the sensing means comprises a thermal sensor capable of sensing a change in water temperature.

4. The invention according to claim 1 wherein the chamber member includes:

at least two water tubes each having a first end and a second end;

a top header integrally associated with the first end of the at least two water tubes; and a bottom header integrally associated with the second end of the at least two water tubes.

5. The invention according to claim 4 wherein the chamber member further includes twelve water tubes.

* * * * *